US006995587B2

(12) United States Patent
Xi

(10) Patent No.: US 6,995,587 B2
(45) Date of Patent: Feb. 7, 2006

(54) LOW VOLTAGE LOW POWER BANDGAP CIRCUIT

(75) Inventor: Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/951,019

(22) Filed: Sep. 27, 2004

(65) Prior Publication Data

US 2005/0035813 A1 Feb. 17, 2005

Related U.S. Application Data

(62) Division of application No. 10/639,988, filed on Aug. 13, 2003.

(51) Int. Cl.
*H03K 5/22* (2006.01)
*H03K 5/153* (2006.01)

(52) U.S. Cl. ..... 327/77; 327/512; 327/539

(58) Field of Classification Search ..... 327/539, 327/512, 513, 72, 77, 80, 81, 83; 323/313, 323/315, 316

See application file for complete search history.

(56) References Cited

U.S. PATENT DOCUMENTS 4,578,633 A * 3/1986 Aoki ..... 323/315
6,512,398 B1 * 1/2003 Sonoyama et al. ..... 327/58
6,690,228 B1 * 2/2004 Chen et al. ..... 327/538
2004/0104763 A1 * 6/2004 Pai ..... 327/539

* cited by examiner

*Primary Examiner*—Quan Tra
(74) *Attorney, Agent, or Firm*—W. Daniel Swayze, Jr.; W. James Brady; Frederick J. Telecky, Jr.

(57) ABSTRACT

Disclosed are methods and circuits for providing a bandgap reference in an electronic circuit having a supply voltage and ground. The methods include steps for generating a bandgap reference current, mirroring the bandgap reference current, summing the mirrored currents, and modulating and outputting a bandgap reference voltage from the sum. Representative preferred embodiments are disclosed in which the methods of the invention are used in providing under-voltage protection and in providing a regulated output voltage. Circuits are disclosed for a bandgap reference voltage generator useful for providing a bandgap reference voltage in a circuit. A first current mirror for provides current from a supply voltage. A bandgap reference current circuit between the first current mirror and ground is configured for deriving a bandgap current proportional to absolute temperature. A second current mirror and control circuit are provided for summing the mirrored currents and modulating a bandgap reference voltage output. Preferred embodiments of the invention include a bandgap under-voltage detection circuit using a comparator and a voltage regulator circuit having a regulated voltage output capability.

2 Claims, 4 Drawing Sheets

LOW VOLTAGE LOW POWER BANDGAP CIRCUIT

TECHNICAL FIELD

This application claims priority under 35 USC § 120 of application Ser. No. 10/639,988, filed Aug. 13, 2003. This application is a divisional of the above mentioned application. The invention relates to reference voltage circuits for IC devices. More particularly, the invention relates to methods and circuits for a bandgap reference generator.

BACKGROUND OF THE INVENTION

Bandgap reference circuits are well known in the analog IC arts for generating a reference voltage based on the bandgap potential inherent in semiconductor materials, generally approximately 1.2 Volts. As IC technology shrinks in size with advances in semiconductor process technology, device supply voltages must inevitably be reduced accordingly to avoid breakdown of the devices. For ICs used in portable electronics, minimal power consumption is also highly desirable. Significant effort is therefore devoted to development of low voltage and low power IC design. Bandgap reference circuits are widely used to provide an accurately known voltage as a fundamental reference for other analog circuit blocks and for generating a bias current or reference current. Since bandgap reference generators provide references for associated circuitry, it is generally desirable to provide bandgap circuits that turn on as early as possible and stay on as long as possible when a supply voltage is present. Thus, it is highly desirable that bandgap circuits operate at low voltage and consume little power.

One commonly used bandgap circuit is the Brokaw cell. A simplified schematic of a Brokaw cell familiar in the arts is illustrated in FIG. 1. The Brokaw cell has an output voltage VBG described by the equation, $$VBG=Vbe+VT\times\ln(N)\times(2\times R2/R1) \quad \text{[Equation 1].}$$

The Brokaw cell is relatively simple and accurate but its usefulness in low voltage applications is limited by its minimum supply voltage requirement, $$VDD>(VBG-Vbe+Vce+Vgs) \quad \text{[Equation 2],}$$

where Vbe is the base-emitter voltage of the bipolar transistors, Vce is the minimum collector-emitter voltage for the linear region of operation for the bipolar transistors, and Vgs is the gate-to-source voltage drop across the PMOS transistors. Those familiar with the arts will recognize that for a typical analog process with MOS VT of 0.7V, the VDD level at which the Brokaw cell functions, referring to Equation 2, is limited to, VDD>(1.24V−0.7V+0.5V+0.8V)=1.84V. The dominant factor in reaching this supply level is that the base is biased at the bandgap voltage level of about 1.24V. Thus, the utility of the Brokaw cell is limited to applications where the minimum input voltage does not fall below the acceptable VDD, in this example 1.84V, substantially higher than the bandgap voltage in general. Also, it will be seen that the total quiescent current of the Brokaw cell shown in the example of FIG. 1 may be described by, $$Iq=2\times Iptat+VBG/R3 \quad \text{[Equation 3].}$$

A lower quiescent current level is desirable in the arts in order to reduce power consumption.

An alternative bandgap circuit known in the arts is the IPTAT (current proportional to absolute temperature) circuit.

A schematic of an IPTAT bandgap circuit known in the arts is depicted in FIG. 2. This type of circuit represents attempts to overcome the limited low voltage range of the Brokaw type circuit. The output bandgap voltage of the circuit of FIG. 2 may be described by, $$VBG=Vbe+VT\times\ln(N)\times(R2/R1)+(Ib\times R2) \quad \text{[Equation 4].}$$

Comparison of Equation 4 with Equation 1 reveals that the error term (Ib×R2) may cause the IPTAT circuit to be less accurate than the Brokaw cell. The IPTAT circuit, however, operates at a lower voltage level as shown by, $$VDD>VBG+Vds \quad \text{[equation 5].}$$

The total quiescent current of the example IPTAT circuit shown in FIG. 2 is, $$Iq=5\times IPTAT \quad \text{[equation 6].}$$

Problems remain in the effort to obtain a bandgap circuit that is accurate, operable at low voltages, and efficient. Due to these and other challenges in implementing low voltage and low power bandgap circuitry, it would be useful and desirable in the arts to provide improved bandgap reference methods and circuits adaptable to various low voltage IC applications. Such methods and devices would be particularly advantageous due to their low voltage operating capabilities and for their capability for maintaining low power consumption, accuracy, and reduced manufacturing costs.

SUMMARY OF THE INVENTION

In carrying out the principles of the present invention, in accordance with preferred embodiments thereof, methods and circuits are provided for efficient, accurate, and reliable bandgap reference capabilities operable at low voltage levels. The methods and circuits of the invention provide technological advantages over the prior art.

According to one aspect of the invention, a method for providing a bandgap reference voltage in an electronic circuit having a supply voltage and ground includes steps for generating a bandgap reference current, mirroring the bandgap reference current, summing the mirrored currents, and outputting a bandgap reference voltage.

Representative preferred embodiments are disclosed in which the method of the invention is used in providing under-voltage protection and in providing a regulated output voltage.

According to another aspect of the invention, a bandgap reference voltage generator for providing a bandgap reference voltage in a circuit having a supply voltage and a ground has a first current mirror for providing a current from the supply voltage. A bandgap reference current circuit between the first current mirror and ground is configured for deriving a bandgap current proportional to absolute temperature. A second current mirror and control circuit are provided for summing the mirrored currents and modulating a bandgap reference voltage output.

According to yet another aspect of the invention, a bandgap reference voltage generator is used for providing under-voltage detection.

According to still another aspect of the invention, a bandgap reference voltage generator is used for providing a voltage regulator circuit having a regulated voltage output capability.

The invention provides bandgap circuits and methods with advantages including but not limited to a low voltage operating range, reduced power consumption, high loop gain, reduced chip area, and reduced cost. These and other features, advantages, and benefits of the present invention will become apparent to one of ordinary skill in the art upon careful consideration of the detailed description of representative embodiments of the invention in connection with the accompanying drawings.

BRIEF DESCRIPTION OF THE DRAWINGS

The present invention will be more clearly understood from consideration of the following detailed description and drawings in which.

Figure 1:
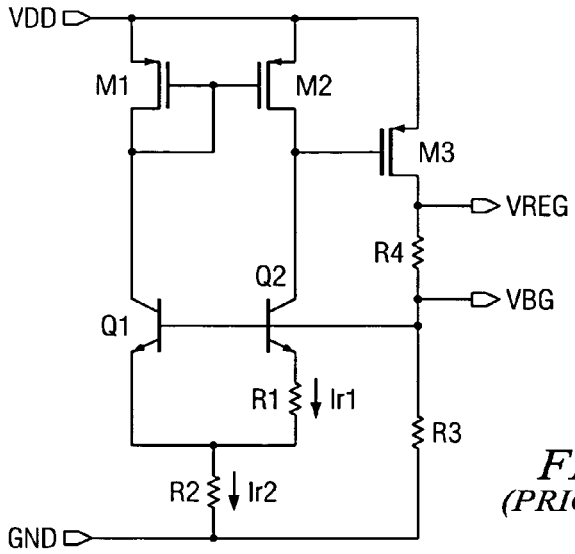
FIG. 1 (PRIOR ART)
FIG. 1 is a schematic block diagram illustrating an example of a bandgap circuit according to the prior art.
Figure 2:
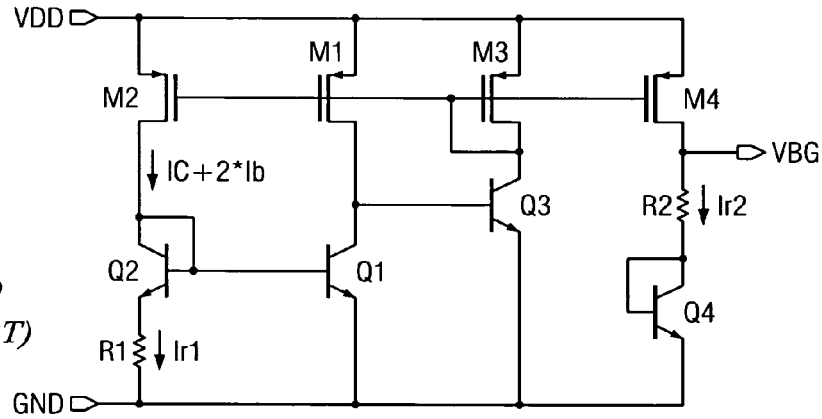
FIG. 2 (PRIOR ART)
FIG. 2 is a schematic diagram illustrating an example of an alternative bandgap circuit according to the prior art.

References in the detailed description correspond to like references in the figures unless otherwise noted. Like numerals refer to like parts throughout the various figures. Descriptive and directional terms used in the written description such as first, second, upper, lower, left, right, etc., refer to the drawings themselves as laid out on the paper and not to physical limitations of the invention unless specifically noted. The drawings are not to scale, and some features of embodiments shown and discussed are simplified or exaggerated for illustrating the principles, features, and advantages of the invention.

DETAILED DESCRIPTION OF PREFERRED EMBODIMENTS

In general, the preferred embodiments of the invention provide bandgap reference circuits that operate at low supply voltages while providing good accuracy with little power consumption. First referring primarily to FIG. 3, a schematic diagram of a bandgap reference circuit 10 according to the invention is shown. For the purposes of providing a context for illustrating the invention, it is assumed that a supply voltage VDD and ground exist in a given electronic circuit or system. Further assuming that it is desired to provide a bandgap reference voltage VBG, the bandgap reference circuit 10 has a first current mirror circuit 12 electrically connected to the supply voltage VDD such that a current, labeled Ic, is produced. Typically, the first current mirror 12 is constructed from first M1 and second M2 field-effect transistors as is known in the arts. Those skilled in the arts will appreciate that variations from the first current mirror circuit 12 shown may be made without departing from the implementation of the invention. The current Ic is provided a path to a bandgap reference current circuit 16.

The bandgap reference current circuit 16 is designed to produce a bandgap current proportional to absolute temperature IPTAT. The bandgap reference current circuit 16 has a first bipolar transistor Q1 connected to a first resistor R1 and a second bipolar transistor Q2 connected in the configuration shown in order to provide a current proportional to absolute temperature (IPTAT) at the first resistor R1, $$IR1=IPTAT=Ic+2Ib \quad \text{[Equation 7].}$$

A second current mirror circuit 18 includes a third bipolar transistor Q3 and Q2 connected to the second field-effect transistor M2 in order to mirror the IPTAT current at the control node VCTL. A fourth bipolar transistor Q4, matched to Q1, is diode-connected and placed between the bandgap reference current circuit 16 and VBG, thus completing a loop where the current at the second resistor R2 is the sum of the mirrored current into the collector of Q4, base current to Q1 and Q4 and IPTAT current into R1, $$Ir2=2\times IPTAT=2Ic+4Ib \quad \text{[Equation 8].}$$

Accordingly, as the bandgap voltage terminal VBG varies from the ideal and drifts around the desired bandgap voltage, the currents through the first and second bipolar transistors, Q1 and Q2 respectively, differ from one another. The mirrored currents reflected at M2 and Q3 continue to be summed at the control node VCTL, modulating the current though a third field-effect transistor M3, which has the effect of counteracting any potential for voltage drift at VBG.

Figure 3:
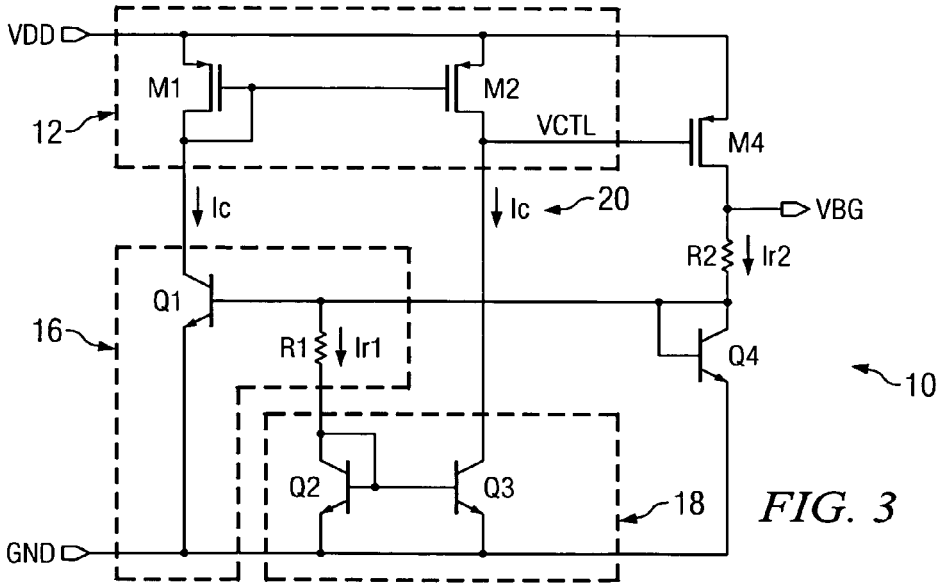
FIG. 3 is a schematic block diagram illustrating an example of the methods and circuits used in the practice of the invention.

Within the circuit 10 shown in FIG. 3, the output at VBG may be expressed, $$VBG=Vbe+VT\times\ln(N)\times(2\times R2/R1) \quad \text{[Equation 9].}$$

This result provides a bandgap voltage output with the same components of a Brokaw cell, but is operable at a much lower supply voltage level, $$VDD>Vce+Vgs \quad \text{[Equation 10].}$$

Thus, the invention advantageously provides accuracy and a low supply voltage operating level. This benefit is obtained by maintaining the base of the bipolar transistors at the Vbe level. Additionally, the bandgap circuit 10 of FIG. 3 has a quiescent current of, $$Iq=4\times IPTAT \quad \text{[Equation 11].}$$

It should also be appreciated by those skilled in the arts that the loop gain possible with the circuit 10 of FIG. 3 is much higher than that of the prior art. The gain stage 20 provided by M2 and Q3 may be manipulated to a selected level of gain and may be used to provide an improved power supply rejection ratio (PSRR).

Figure 4:
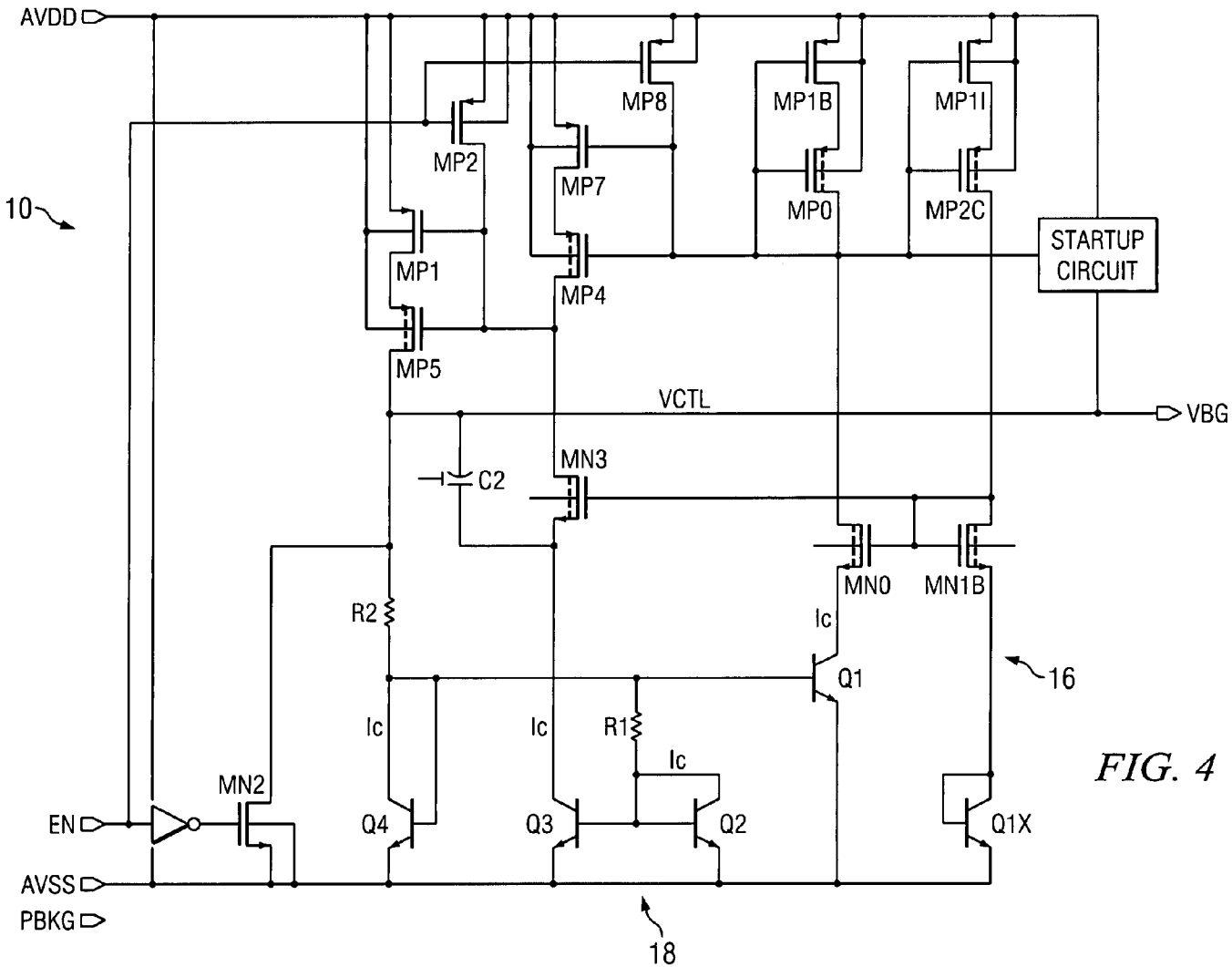
FIG. 4 is a schematic diagram further illustrating an embodiment of a bandgap reference circuit according to the example of FIG. 3.
Figure 5:
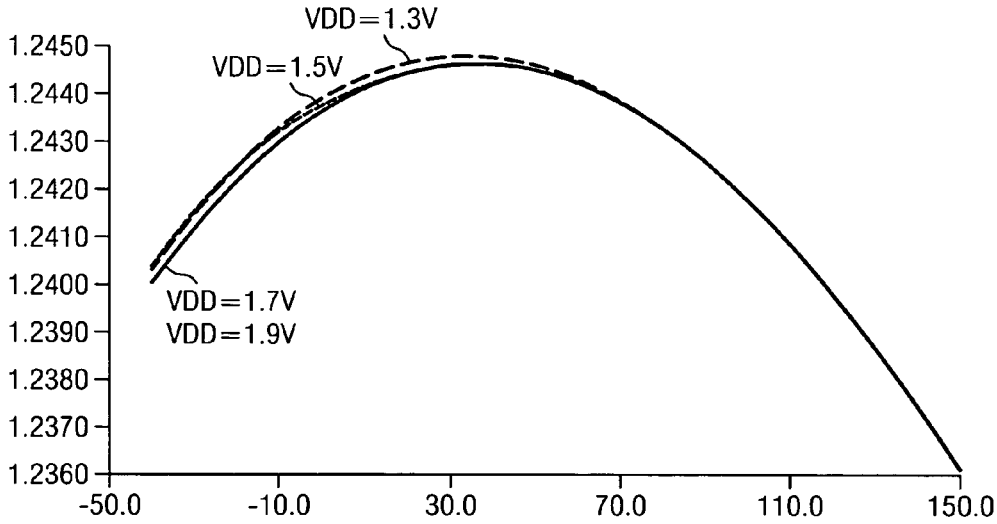
FIG. 5 is a graphical representation of the performance of a bandgap reference circuit according to the embodiment of FIG. 4.

In FIG. 4, a further example of an embodiment of a bandgap circuit 10 according to the invention is shown in a transistor-level view. The first current mirror 12 provides current Ic to the bandgap reference current circuit 16. The second current mirror 18 mirrors the IPTAT current at the control node VCTL. A graphical representation of the operation of the bandgap circuit of FIG. 4 is shown in FIG. 5. The x-axis represents the temperature and the y-axis represents the bandgap voltage VBG. It may be seen by the curves that a reliable bandgap voltage is produced at four VDD levels, 1.3V, 1.5V, 1.7V, and 1.9V, demonstrating the low supply voltage VDD capabilities of the invention.

Figure 6:
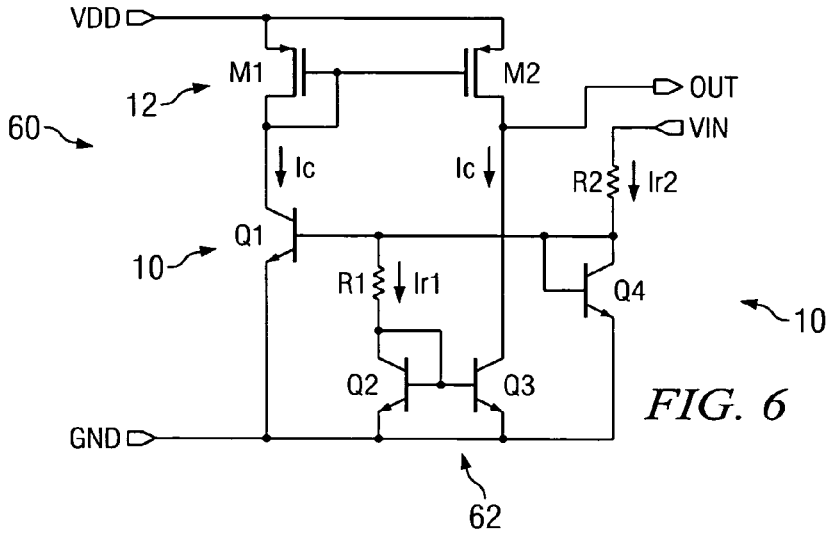
FIG. 6 is a schematic block diagram illustrating an alternative bandgap reference circuit used in an under-voltage detector circuit according to a preferred embodiment of the invention.

Referring now primarily to FIG. 6, a schematic diagram shows an example of a preferred embodiment of the invention in an under-voltage detection circuit 60. The bandgap circuit 10 is configured as described, but is further adapted to be operated to compare the bandgap voltage VBG with an input voltage VIN. Rather than the second current mirror circuit shown in FIG. 3, the under-voltage detection circuit 60 has a comparator circuit 62 for comparing the bandgap voltage VBG induced in the bandgap circuit 10 with the voltage at the input node VIN. An output VOUT is then produced based on the comparison, indicating the existence, or non-existence, of an under-voltage condition. For example, an output VOUT of "0" may be used when VBG>VIN, and an output VOUT of "1" when VBG<VIN. With the under-voltage circuit 60 of FIG. 4, the minimum supply voltage VDD for producing a valid output is the same as for the bandgap circuit, VDD>Vce+Vgs given by Equation 10. An additional advantage of this circuit 60 is that it gives an output VOUT in a form that can interface directly with additional CMOS logic components without modification or level shifting.

Figure 7:
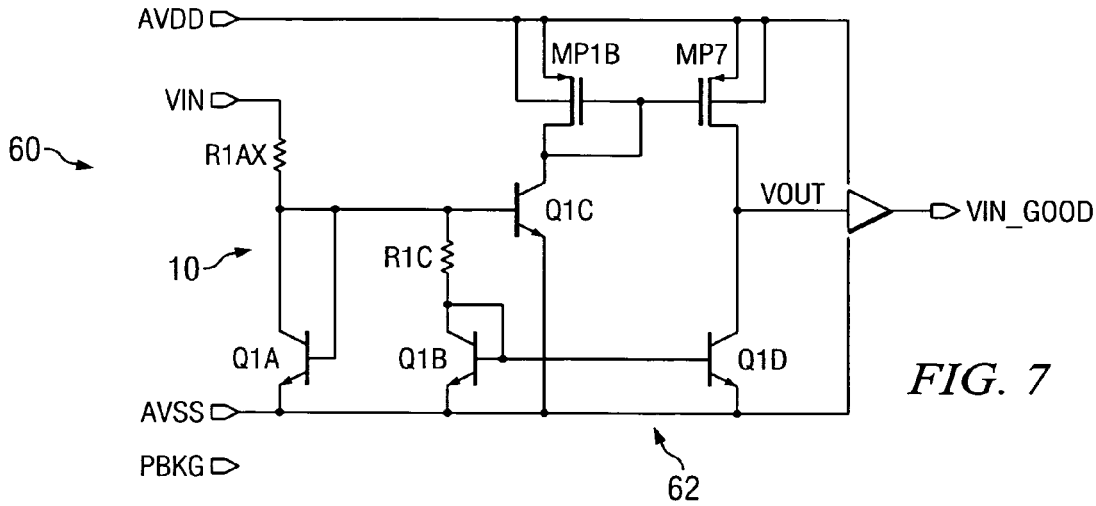
FIG. 7 is a schematic diagram further illustrating an embodiment of an under-voltage detector circuit according to the example of FIG. 6.
Figure 8:
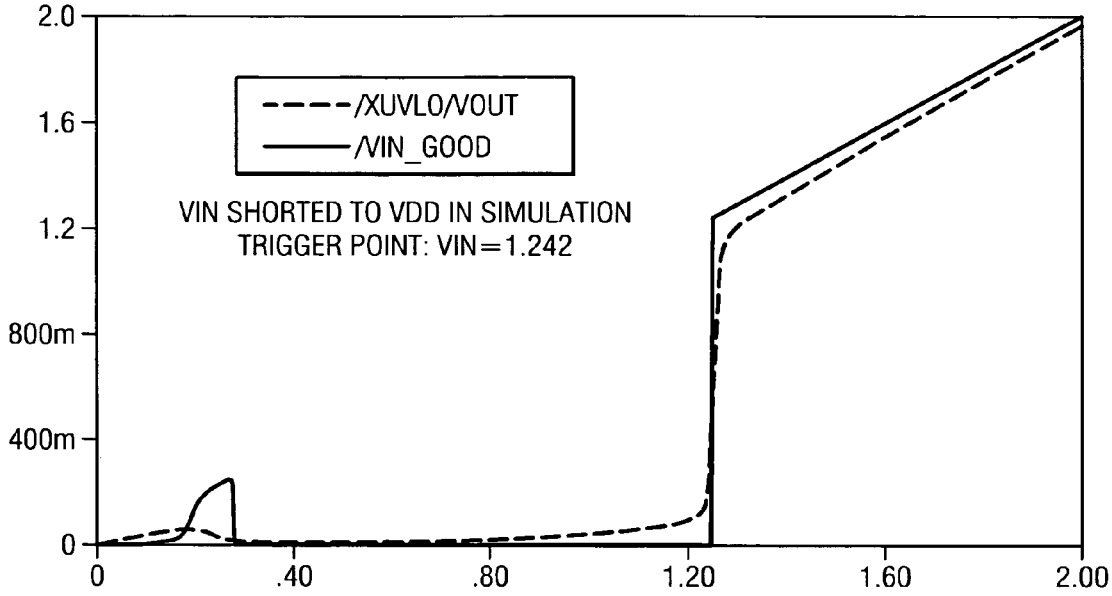
FIG. 8 is a graphical representation of the performance of the under-voltage detector circuit according to the example of FIG. 7.

In FIG. 7, a further example of an alternative embodiment of a bandgap circuit 10 according to the invention is shown in a transistor-level view. The under-voltage detection circuit 60 uses the bandgap circuit 10 with a comparator 62 to evaluate VIN with reference to the bandgap voltage VBG. A graphical representation of the operation of the bandgap circuit of FIG. 7 is shown in FIG. 8. The DC response of the circuit 60 is shown where the x-axis represents input voltage VIN and the y-axis represents the under-voltage detection circuit output. It may be seen by the curves that the under-voltage circuit 60 is responsive at input voltages VIN of approximately 1.242V, which in this example is about equal to the bandgap voltage VBG.

Figure 9:
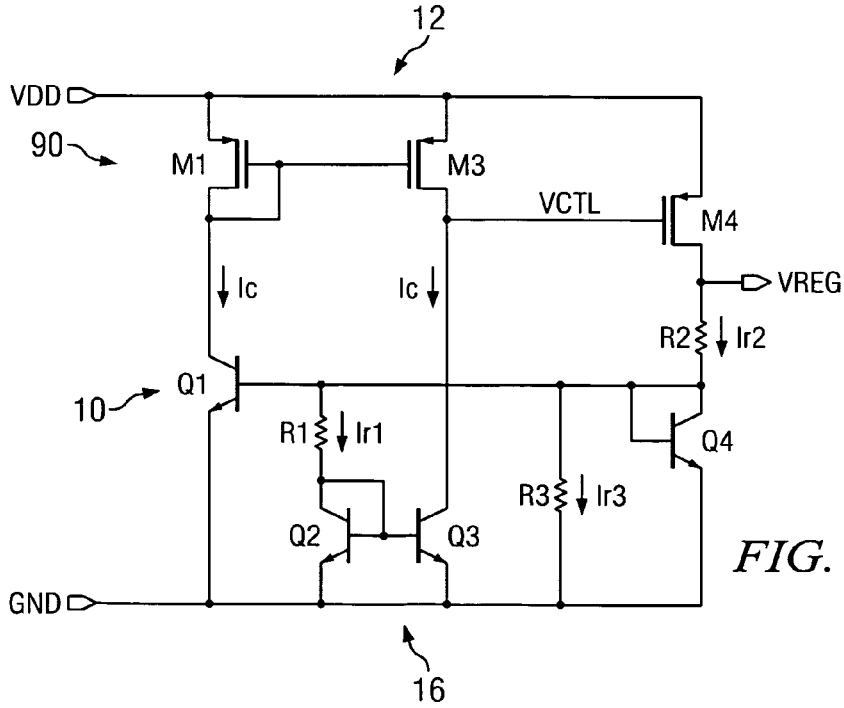
FIG. 9 is a schematic block diagram illustrating an example of an alternative embodiment of the invention using the bandgap reference circuit in a voltage regulator.

Referring now primarily to FIG. 9, a schematic diagram shows an example of a preferred embodiment of the invention in a voltage regulator circuit 90. The bandgap circuit 10 as described is used with modification of the control circuit. A regulated voltage output VREG is provided, using the bandgap voltage VBG as a reference. By the addition of a third resistor R3 at the base of the bandgap circuit 10, and by adjusting the size of the second resistor R2, the output voltage may be arbitrarily adjusted upward of the bandgap voltage VBG. Examination of the circuit 90 reveals that the current at the third resistor R3 is given by, $$Ir3=Vbe/R3 \quad \text{[Equation 12].}$$

Equation 8 may be then modified to indicate the current through the second resistor, $$Ir2=2\times IPTAT+Vbe/R3 \quad \text{[Equation 13].}$$

The regulated output voltage VREG is therefor given by, $$VREG=Vbe+Vbe\times(R2/R3)+2\times IPTAT\times R2 \quad \text{[Equation 14],}$$

which is equal to, $$VREG=Vbe\times(1+R2/R3)+VT\times\ln(N)\times(2\times R2/R1) \quad \text{[Equation 15].}$$

Thus, using the bandgap circuit of the invention as an internal reference, an accurate voltage regulator circuit is provided.

The invention provides low voltage, low power bandgap reference circuits and methods. The invention may be readily applied in IC applications with favorable power and cost savings and advantageous low voltage operating ranges. While the invention has been described with reference to certain illustrative embodiments, the methods and devices described are not intended to be construed in a limiting sense. For example, with suitable modification, alternative transistor types may be substituted in the circuits shown and described without departing from the principles of the invention. Various modifications and combinations of the illustrative embodiments as well as other advantages and embodiments of the invention will be apparent to persons skilled in the art upon reference to the description and claims.

I claim:

1. An under-voltage detection circuit for providing under-voltage detection in a circuit having a supply voltage VDD, a ground, and an input voltage Vin, the under-voltage detection circuit comprising:

a first current mirror circuit operatively coupled to the supply voltage VDD;

a bandgap reference current circuit operatively coupled to the first current mirror and ground, the bandgap reference circuit adapted for deriving a bandgap current proportional to absolute temperature, IPTAT;

an input node for accepting an input voltage Vin;

an input resistor coupled to the input node for inducing an input current Iin;

a comparator circuit coupled to the bandgap reference circuit and the input node for comparing the IPTAT and the input current Iin;

an output node coupled to the comparator for providing either a high output or a or low output indication of whether an under-current condition exists, wherein the bandgap reference current circuit further comprises:

a first bipolar transistor having a collector operably coupled to the first current mirror and an emitter coupled to ground; and a first resistor operably coupled to a base of the first bipolar transistor.

2. An under-voltage detection circuit for providing under-voltage detection in a circuit having a supply voltage VDD, a ground, and an input voltage Vin, the under-voltage detection circuit comprising:

a first current mirror circuit operatively coupled to the supply voltage VDD;

a bandgap reference current circuit operatively coupled to the first current mirror and ground, the bandgap reference circuit adapted for deriving a bandgap current proportional to absolute temperature, IPTAT;

an input node for accepting an input voltage Vin;

an input resistor coupled to the input node for inducing an input current Iin;

a comparator circuit coupled to the bandgap reference circuit and the input node for comparing the IPTAT and the input current Iin;

an output node coupled to the comparator for providing either a high output or a or low output indication of whether an under-current condition exists, wherein the comparator circuit further comprises:

a second bipolar transistor having a collector operably coupled to the bandgap reference current circuit, a base coupled to the collector, and an emitter coupled to ground; and a third bipolar transistor having a collector operably coupled to the first current mirror, a base coupled to the base of the second bipolar transistor, and an emitter coupled to ground.

* * * * *